US009749725B2

(12) United States Patent
Naito et al.

(10) Patent No.: US 9,749,725 B2
(45) Date of Patent: Aug. 29, 2017

(54) WIRELESS MICROPHONE WITH ANTENNA THEREIN

(71) Applicant: KABUSHIKI KAISHA AUDIO-TECHNICA, Machida-shi, Tokyo (JP)

(72) Inventors: Yoshihiko Naito, Machida (JP); Akira Masuda, Machida (JP)

(73) Assignee: KABUSHIKI KAISHA AUDIO-TECHNICA, Machida-Shi, Tokyo (JP)

( * ) Notice: Subject to any disclaimer, the term of this patent is extended or adjusted under 35 U.S.C. 154(b) by 0 days.

(21) Appl. No.: 14/930,008

(22) Filed: Nov. 2, 2015

(65) Prior Publication Data

US 2016/0142802 A1 May 19, 2016

(30) Foreign Application Priority Data

Nov. 14, 2014 (JP) ..... 2014-231261

(51) Int. Cl.

| | |
|---|---|
| ***H04R 25/00*** | (2006.01) |
| ***H04R 1/04*** | (2006.01) |
| *H04R 1/06* | (2006.01) |
| *H04R 1/08* | (2006.01) |

(52) U.S. Cl.

CPC ..... *H04R 1/04* (2013.01); *H04R 1/06* (2013.01); *H04R 1/083* (2013.01); *H04R 2420/07* (2013.01)

(58) Field of Classification Search

CPC ..... H04R 1/08; H04R 2420/07; H04R 1/04; H04R 2499/15; H04R 1/083; H04R 1/06

USPC ..... 381/355, 361; 455/95

See application file for complete search history.

(56) References Cited

U.S. PATENT DOCUMENTS

| | | | | |
|---|---|---|---|---|
| 3,718,862 A * | 2/1973 | Norris | H04B 5/06 455/117 |
| 4,344,184 A * | 8/1982 | Edwards | H04B 1/04 343/702 |
| 4,910,795 A * | 3/1990 | McCowen | H04R 1/083 381/355 |
| 5,706,359 A * | 1/1998 | Chang | H04R 1/08 381/355 |
| D422,281 S * | 4/2000 | Tang | H04R 1/08 D14/228 |
| 6,463,159 B1 * | 10/2002 | Ming-Cheng | H04R 1/08 381/355 |

(Continued)

FOREIGN PATENT DOCUMENTS

JP S63-18230 A 5/1988

*Primary Examiner* — Davetta W Goins
*Assistant Examiner* — Phylesha Dabney
(74) *Attorney, Agent, or Firm* — Manabu Kanesaka

(57) ABSTRACT

In a wireless microphone having an antenna in a lower part of a main body, a wireless microphone in which a microphone main body serves as a ground plane, which secures stable antenna ground by being gripped by a user, and which is capable of obtaining good RF performance is provided. The microphone main body includes a holder member made of metal for holding at least an antenna circuit part, a cylindrical cover member made of metal for covering a periphery of the holder member, and a cylindrical grip end member made of metal, inserted into a rear end side of the cover member, and connected with a rear part side of the holder member. The holder member has conduction with the cover member via the grip end member.

6 Claims, 4 Drawing Sheets

(56) References Cited

U.S. PATENT DOCUMENTS

| | | | | |
|---|---|---|---|---|
| 6,778,814 | B2 * | 8/2004 | Koike | H04B 1/04 381/92 |
| 7,801,321 | B2 * | 9/2010 | Akino | H04R 1/04 381/355 |
| 7,974,429 | B2 * | 7/2011 | Tsai | H04R 1/08 381/355 |
| 2016/0005341 | A1 * | 1/2016 | Levinsohn | G09F 23/04 381/91 |
| 2016/0142802 | A1 * | 5/2016 | Naito | H04R 1/04 381/361 |
| 2016/0142804 | A1 * | 5/2016 | Naito | H04R 3/00 381/94.5 |

* cited by examiner

WIRELESS MICROPHONE WITH ANTENNA THEREIN

RELATED APPLICATIONS

The present application is based on, and claims priority from, Japanese Application No. JP2014-231261 filed Nov. 14, 2014, the disclosure of which is hereby incorporated by reference herein in its entirety.

BACKGROUND OF THE INVENTION

Field of the Invention

The present invention relates to a wireless microphone, and particularly to a wireless microphone having an antenna in a rear part of a microphone main body.

Description of the Related Art

Conventionally, a wireless microphone includes a microphone head that accommodates a microphone unit for performing sound collection and a microphone main body connected with this microphone head.

The microphone main body is formed by a holder member (a body) for holding a circuit board, a battery, an antenna, and the like and a cover member for covering this holder member (a gripping case portion). When the holder member is connected with the cover member, the circuit board, the battery, and the like are fixed within the cover member.

It should be noted that in a configuration disclosed in JP 63-18230 Y, connection between a holder member (a battery accommodation part, a board accommodation part) and a cover member (an outer shell) is performed by screwing a screw groove formed on an inner peripheral surface on a front part side of the cover member and a screw groove formed on an outer peripheral surface on a front part side of a main body part.

Incidentally, in the wireless microphone, an antenna is generally provided in a rear part of the microphone main body (a rear part of the holder member).

Because of this, when the holder member and the cover member are made of metal and caused to have conduction and to connect to ground of the circuit board, the microphone main body can serve as a ground plane by gripping the cover member serving as a gripping portion with a palm of a hand of a user.

However, in the configuration disclosed in JP 63-18230 Y, in a case where the holder member and the cover member are connected with each other on the front side, a connecting position thereof is separated from a position of an antenna (a rear part of the holder member). Accordingly, the cover member is in a floating state in a high frequency manner using the antenna as a reference.

Consequently, there are problems in that, even when the cover member is gripped, stable antenna ground cannot be taken, and good RF (Radio Frequency) performance cannot be obtained.

SUMMARY OF THE INVENTION

The present invention is made to focus on the above-described points. In a wireless microphone having an antenna in a lower part of a main body, an object of the present invention is to provide the wireless microphone in which a microphone main body serves as a ground plane, which secures stable antenna ground by being gripped by a user, and which is capable of obtaining good RF performance.

In order to solve the issue, a wireless microphone according to the present invention includes: a microphone head including a microphone unit for performing sound collection; and a microphone main body connected to a rear part of the microphone head, wherein the microphone main body includes: a holder member made of metal for holding at least an antenna board part; a cylindrical cover member made of metal for covering a periphery of the holder member; and a cylindrical grip end member made of metal, inserted into a rear end side of the cover member, and connected with a rear part side of the holder member, and the holder member has conduction with the cover member via the grip end member.

Note that it is desirable that an antenna of the antenna circuit part be provided so as to protrude rearward from a rear part opening of the grip end member.

Further, it is desirable that the holder member and the grip end member be connected by screwing a screw groove formed on an outer peripheral surface on the rear part side of the holder member and a screw groove formed on an inner peripheral surface side of the grip end member.

Further, it is desirable that the grip end member have a plurality of terminal parts provided in a leg shape on a peripheral edge on a front side of the grip end member and, when the grip end member is attached to the cover member, the terminal parts abut an inner peripheral surface of the cover member.

By configuring in this way, ground can be taken in the grip end member near the antenna circuit part.

Accordingly, when a user of the wireless microphone grips the cover member of the microphone main body with a palm of a hand, stable antenna ground is secured, and good RF performance can be obtained.

Further, since the sufficient antenna ground can be secured, radio wave radiation efficiency becomes good, and an operation distance as the wireless microphone can be extended.

DESCRIPTION OF THE PREFERRED EMBODIMENT

Figure 1:
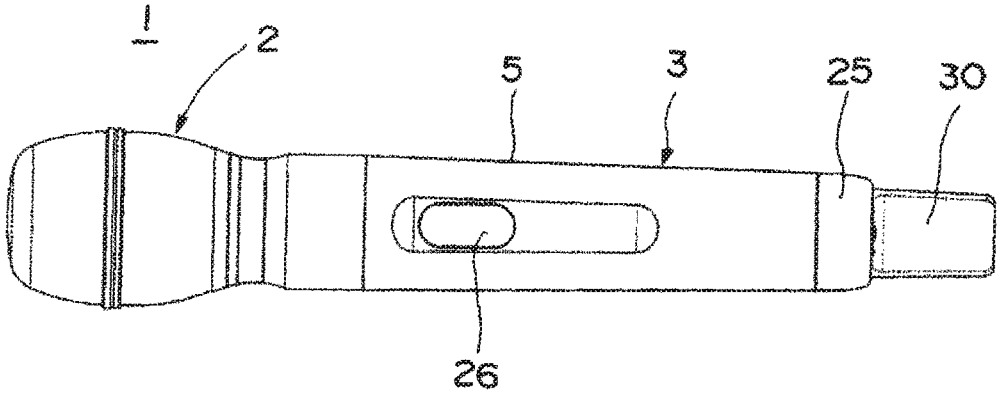
FIG. 1 is a plan view of a microphone according to the present invention.
Figure 2:
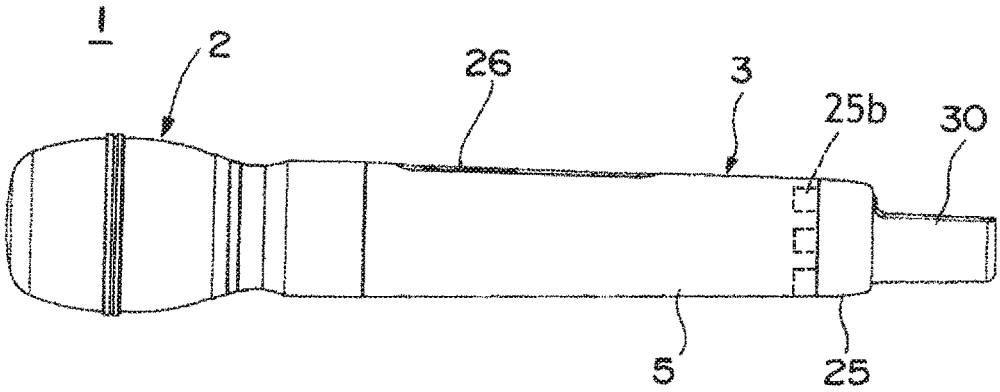
FIG. 2 is a side view of the microphone in FIG. 1.

Hereinafter, an embodiment of the present invention will be described based on drawings. FIG. 1 is a plan view of a wireless microphone according to the present invention, and FIG. 2 is a side view thereof.

An illustrated wireless microphone 1 is configured by a microphone head 2 that incorporates a microphone unit for performing sound collection and a microphone main body 3 detachably provided to this microphone head 2. Further, the wireless microphone 1 includes an antenna part 30 (an antenna circuit) for wirelessly outputting an audio signal in a rear part of the microphone main body 3, and a display window 26 is provided on an outer peripheral surface thereof.

The microphone main body 3 is configured by a main body member 4 formed of a plurality of boards or the like and a cylindrical cover member 5 made of metal (e.g., made of aluminum) for accommodating this main body member 4.

Figure 3:
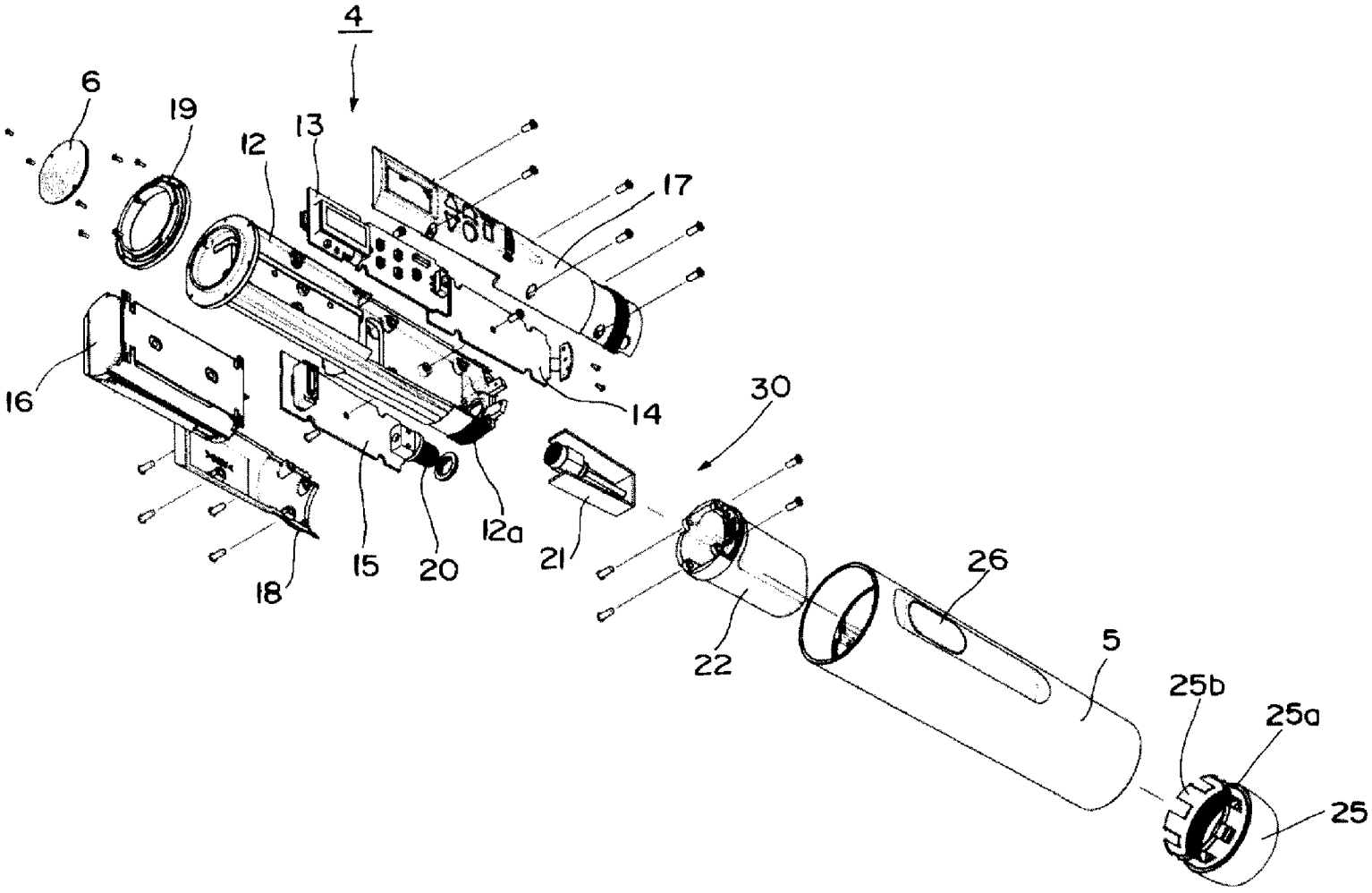
FIG. 3 is a perspective view illustrated by disassembling a microphone main body.
Figure 4:
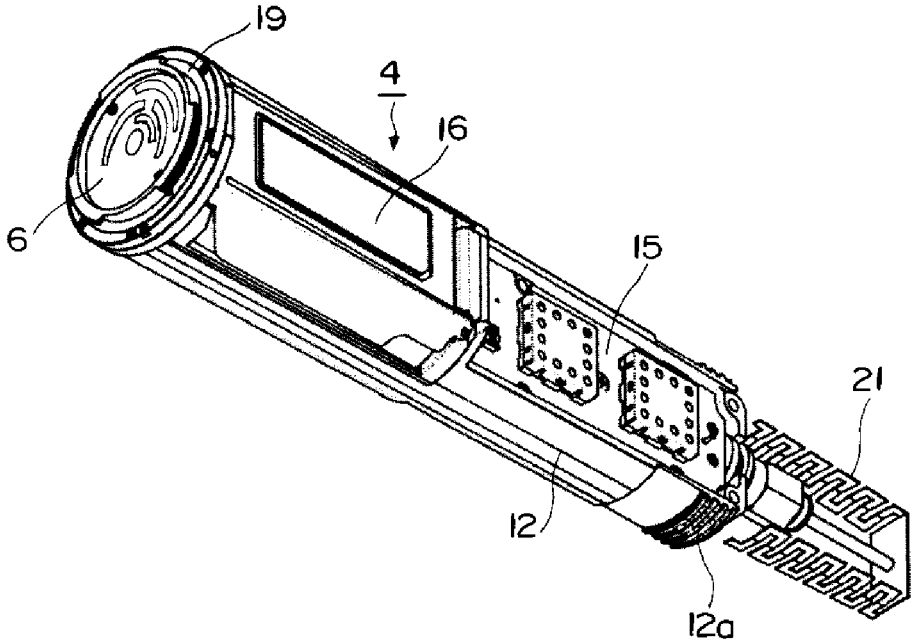
FIG. 4 is a perspective view illustrating an obverse side of a main body member.
Figure 5:
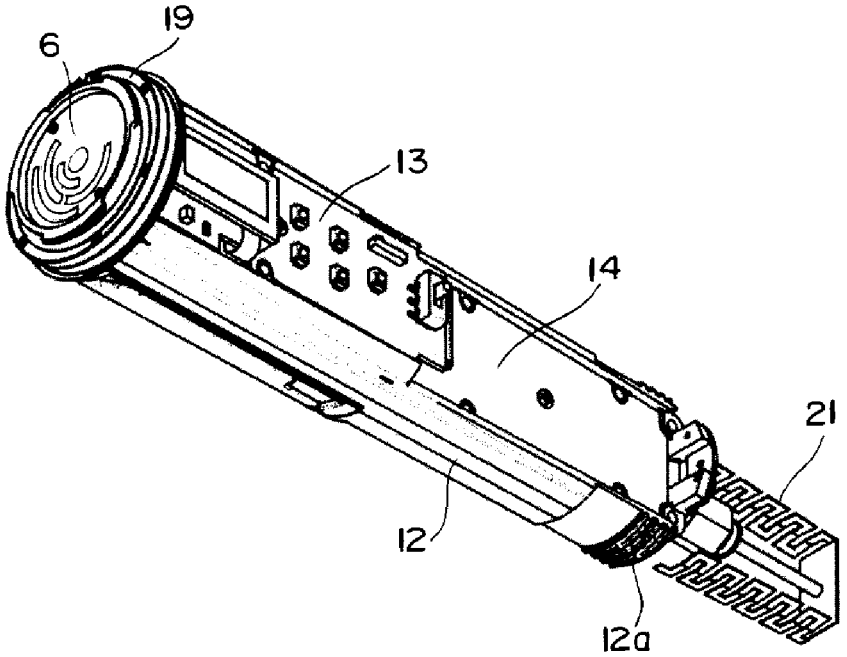
FIG. 5 is a perspective view illustrating a reverse side of the main body member.

FIG. 3 is a perspective view illustrated by disassembling the microphone main body 3. Further, FIG. 4 is a perspective view illustrating an obverse side of the main body member 4, and FIG. 5 is a perspective view illustrating a reverse side of the main body member 4. Further, FIG. 6 is a perspective view of an antenna.

The main body member 4 of the microphone main body 3 includes a holder member 12 made of metal (e.g., made of aluminum), and a main board 13, an audio board 14, and an antenna board 15 are respectively mounted to this holder member 12 by a plurality of screws. Further, a battery box 16 for accommodating a battery is mounted to the holder member 12, and covers 17, 18 are mounted thereto by screws so as to cover exposed surfaces of the boards 13, 14, 15.

Further, a contact board 6 for giving/receiving an audio signal to/from the microphone head 2 side via an attachment member 19 is provided on a front end side of the holder member 12.

Figure 6:
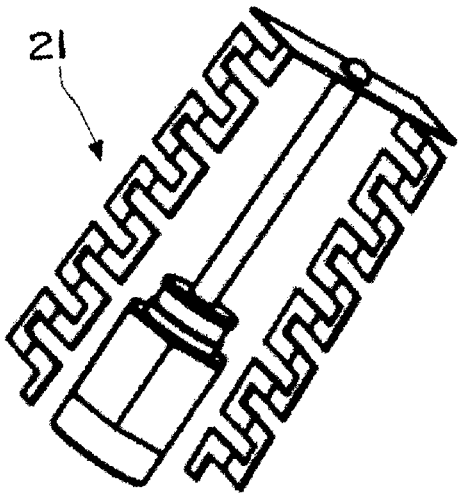
FIG. 6 is a perspective view of an antenna included in the microphone in FIG. 1.

Further, as illustrated in FIG. 6, for example, a zigzag-shaped metal plate is used for an antenna 21 as an antenna element, and the antenna 21 is mounted to the antenna board 15 via an antenna connector 20. The antenna part 30 is configured by covering this antenna 21 with an antenna cover 22. The antenna 21 is, for example, an unbalanced monopole antenna.

Further, a screw groove 12*a* is formed on a rear part side of the holder member 12, and at least this screw groove 12*a* is not painted and a metal surface thereof is exposed. On the other hand, a cylindrical grip end member 25 formed of, for example, brass is fitted in a rear end part of the cover member 5 so as to be freely rotatable, and a screw groove 25*a* for screwing into the screw groove 12*a* formed on the holder member 12 side is formed on an inner peripheral surface of this grip end member 25. The screw groove 25*a* is also not painted and a metal surface thereof is exposed.

The main body member 4 (the holder member 12) is inserted into the cover member 5 from the antenna part 30 side provided in the lower part, and in the rear part side thereof, the screw groove 12*a* is screwed into the screw groove 25*a* of the grip end member 25 inserted from the rear end part of the cover member 5 (by rotating the grip end member 25*a*). The connection by screwing in this way makes it possible to secure a mutually contacting area and to cause the main body member 4 and the grip end member 25 to have reliable conduction.

Further, a plurality of terminal parts 25*b* that is not painted and whose metal surface is exposed is provided in a leg shape in a peripheral edge part on a front side of the grip end member 25. When the grip end member 25 is attached to the cover member 5, the terminal parts 25*b* are made to abut an inner peripheral surface of the cover member 5 whose metal surface is exposed. It should be noted that when the grip end member 25 attached to the cover member 5 is rotated so as to screw into the main body member 4 (the holder member 12), the terminal parts 25*b* slidably contact the inner peripheral surface of the cover member 5.

With this configuration, a conduction state of the holder member 12 of the main body member 4, the grip end member 25, and the cover member 5 is secured.

In this way, according to the embodiment of the present invention, in the microphone main body 3, the rear part side of the holder member 12 made of metal (made of aluminum) for holding the various boards has conduction with the grip end member 25 made of metal (made of brass), and the grip end member 25 has conduction with the cover member 5 made of metal (made of aluminum). In other words, the microphone main body 3 serves as a ground plane, and ground can be taken in the antenna part 30 or the grip end member 25 near the antenna board 15.

Accordingly, when a user of the wireless microphone 1 grips the cover member 5 of the microphone main body 3 with a palm of a hand, stable antenna ground is secured, and good RF performance can be obtained.

Further, since the sufficient antenna ground can be secured, radio wave radiation efficiency becomes good, and an operation distance as the wireless microphone can be extended.

It should be noted that in the above-described embodiment, the antenna with the zigzag-shaped metal plate as illustrated in FIG. 6 is illustrated as the shape of the antenna 21. However, the present invention is not limited to that form, and a conventional general monopole antenna can be suitably used as the antenna.

What is claimed is:

1. A wireless microphone comprising:

a microphone head including a microphone unit for performing sound collection; and a microphone main body connected to a rear part of the microphone head, wherein the microphone main body includes:

a holder member made of metal for holding at least an antenna board part;

a cylindrical cover member made of metal for covering a periphery of the holder member; and a cylindrical grip end member made of metal, inserted into a rear part side of the cover member, and connected with a rear part side of the holder member, the grip end member has a plurality of terminal parts provided in a leg shape on a peripheral edge on a front side of the grip end member, and when the grip end member is attached to the cover member, the terminal parts with metal faces abut against an inner peripheral surface of the cover member with metal faces being exposed, each of the plurality of terminal parts having the leg shape is arranged to have a space with the terminal part adjacent thereto along the peripheral edge on the front side of the grip end member, and the holder member has conduction with the cover member via the grip end member.

2. The wireless microphone according to claim 1, wherein an antenna of the antenna circuit part is provided so as to protrude rearward from a rear opening of the grip end member.

3. The wireless microphone according to claim 2, further comprising an antenna cover that is enclosed in the cylindrical cover and that covers the antenna.

4. The wireless microphone according to claim 1, wherein the holder member and the grip end member are connected by screwing a screw groove formed on an outer peripheral surface of the rear part side of the holder member and a screw groove formed on an inner peripheral surface side of the grip end member.

5. The wireless microphone according to claim 1, wherein the antenna board part includes an antenna connector at a rear part thereof, and an antenna in a form of zigzag shape made of metal and connected to the antenna connector.

6. The wireless microphone according to claim 5, wherein the microphone main body further includes an antenna cover covering the antenna, the antenna cover with the antenna therein extending rearwardly from the grip end member.

* * * * *